US011395535B2

(12) United States Patent
Dunton et al.

(10) Patent No.: US 11,395,535 B2
(45) Date of Patent: Jul. 26, 2022

(54) KEYED REFILLABLE COSMETIC DISPENSER

(71) Applicant: HCP Packaging USA, Inc., Shelton, CT (US)

(72) Inventors: David P. Dunton, Stratford, CT (US); Stephen G. Dudienski, Ansonia, CT (US)

(73) Assignee: HCP Packaging USA, Inc., Shelton, CT (US)

( * ) Notice: Subject to any disclaimer, the term of this patent is extended or adjusted under 35 U.S.C. 154(b) by 23 days.

(21) Appl. No.: 17/031,184

(22) Filed: Sep. 24, 2020

(65) Prior Publication Data

US 2022/0087398 A1 Mar. 24, 2022

(51) Int. Cl.
*A45D 40/16* (2006.01)
*A45D 40/04* (2006.01)

(52) U.S. Cl.
CPC ..... *A45D 40/04* (2013.01); *A45D 40/16* (2013.01)

(58) Field of Classification Search
CPC ..... A45D 40/02; A45D 40/04; A45D 40/12; A45D 40/16; A45D 2040/0043
See application file for complete search history.

(56) References Cited

U.S. PATENT DOCUMENTS 1,999,263 A 4/1935 Thesmar
2,815,122 A 12/1957 Lerner et al.
3,298,509 A 1/1967 Hultgren
4,505,607 A 3/1985 Sugiyama
5,172,993 A 12/1992 Ackermann et al.
5,186,560 A 2/1993 Holloway
5,186,561 A 2/1993 Ackermann et al.
5,324,125 A 6/1994 Ackermann
5,324,126 A 6/1994 Holloway et al.
5,348,410 A 9/1994 Shozi et al.
5,399,040 A 3/1995 Holloway
5,649,777 A 7/1997 Holloway
(Continued)

FOREIGN PATENT DOCUMENTS

EP 0572031 A1 12/1993
FR 1118520 A * 6/1956 ..... A45D 40/16
(Continued)

*Primary Examiner* — Jennifer C Chiang
(74) *Attorney, Agent, or Firm* — Thomas P. O'Connell; O'Connell Law Firm

(57) ABSTRACT

A keyed refillable cosmetic dispenser for a stick cosmetic. The cosmetic dispenser has a cosmetic insert cartridge and a dispenser base with a matching key pattern combination. The insert cartridge has an inner body with a key pattern, an elevator cup, and a rotary extension and retraction mechanism for the elevator cup and a retained cosmetic. The key pattern of the insert cartridge can be a keyway in a keyway member of the inner body, and the key pattern of the dispenser base can be formed on a central column that forms a key member. The key patterns can be patterns of surface deviations, such as ridges and channels, that intermesh when the cosmetic insert cartridge is received by the dispenser base to produce a rotary driving engagement therebetween. A line of keyed cosmetic dispensers can be established by plural cosmetic dispensers with different key pattern combinations.

31 Claims, 18 Drawing Sheets

(56) References Cited

U.S. PATENT DOCUMENTS

| | | | | |
|---|---|---|---|---|
| 5,791,799 | A | 8/1998 | Oehlhorn | |
| 5,842,805 | A | 12/1998 | Pierpont | |
| 5,851,078 | A | 12/1998 | Bow et al. | |
| 6,036,387 | A | 3/2000 | Gueret | |
| 6,126,351 | A | 10/2000 | Gueret | |
| 6,158,911 | A | 12/2000 | Seebach, Jr. et al. | |
| 6,200,047 | B1 | 3/2001 | Holloway | |
| 6,200,049 | B1 | 3/2001 | Pinhel et al. | |
| 6,231,254 | B1 | 5/2001 | Holloway | |
| 6,293,721 | B1 | 9/2001 | Bow et al. | |
| 6,412,999 | B1 | 7/2002 | Pierpont | |
| 6,543,953 | B1 | 4/2003 | Kim | |
| 7,325,991 | B2 | 2/2008 | Holloway | |
| 7,357,588 | B2 | 4/2008 | Liard | |
| 7,500,799 | B2 | 3/2009 | Holloway | |
| 9,433,276 | B2 | 9/2016 | McNamara et al. | |
| 9,474,349 | B2 | 10/2016 | Holloway | |
| 2007/0217857 | A1 | 9/2007 | Ho | |
| 2008/0283556 | A1 | 11/2008 | Snodgrass | |
| 2015/0296958 | A1 | 10/2015 | Holloway | |
| 2016/0015149 | A1 | 1/2016 | Kim et al. | |
| 2021/0068517 | A1* | 3/2021 | Trochel | A45D 40/06 |

FOREIGN PATENT DOCUMENTS

| | | | |
|---|---|---|---|
| WO | WO1995001743 | A1 | 1/1995 |
| WO | WO2020127321 | | 6/2020 |

* cited by examiner

KEYED REFILLABLE COSMETIC DISPENSER

FIELD OF THE INVENTION

The present invention relates generally to cosmetic dispensers. More particularly, disclosed herein is a keyed cosmetic dispenser and a line of such keyed cosmetic dispensers formed with differently keyed cosmetic cartridges that are engagable and operable only with correspondingly-keyed dispenser bases.

BACKGROUND OF THE INVENTION

In a typical dispenser for a stick cosmetic, an elevator cup retains the cosmetic for axial extension and retraction by a rotation of a base portion relative to a body portion. Dispensers commonly employ a tubular cam member that is rotatably associated with a tubular inner body. The cam member has channels that communicate helically along the inner surface thereof, and the inner body has opposed longitudinal slots. Opposed lugs of an elevator cup, which retains the cosmetic, are received through the longitudinal slots to engage the helical channels of the cam member. A rotation of the cam member in relation to the inner body induces longitudinal travel of the elevator cup and the retained cosmetic as the lugs of the elevator cup slide along the helical channels of the cam member and are thereby driven along the longitudinal channels of the inner body. Relative rotation of the cam member and the inner body in a first direction will extend the elevator cup, and relative rotation of the cam member and the inner body in a second, opposite direction will retract the elevator cup.

It is desirable to be able to fill and refill cosmetic dispensers with cosmetic sticks, such as once a given cosmetic is spent or no longer desired. For instance, refillable cosmetic dispensers have been increasingly appreciated as being more environmentally sound and efficient while disposable packaging is often recognized as wasteful and irresponsible. Furthermore, by permitting the cosmetic of a given dispenser to be refilled, greater resources can be expended in rendering the cosmetic dispenser an aesthetically desirable, luxury item. Accordingly, a cosmetic dispenser that is simultaneously environmentally friendly and imbibed with enhanced luxury and beauty is now a sought-after advance in the art.

However, producers of cosmetic dispensers typically do not wish for their cosmetic dispenser bases to be refilled with third party cosmetics. Although beneficial for permitting extended usage of a given cosmetic dispenser, the modularity that facilitates replenishing the cosmetic often simultaneously facilitates the use of third party cosmetics relative to a given producer's cosmetic dispenser base. This can result not only in lost sales but also reputational and business harm where unbranded and inferior cosmetics are used relative to a dispenser base of a particular producer. It is also known that certain cosmetic refill cartridges and the retained cosmetic can be used altogether independently of the cosmetic base for which they were designed.

It has thus been recognized by the present inventors that it would be advantageous to devise of cosmetic insert cartridges and cosmetic dispenser bases for such cartridges that are differently keyed to one another to promote usage of keyed cosmetic insert cartridges only with correspondingly keyed cosmetic dispenser bases.

SUMMARY OF THE INVENTION

In view of the foregoing, the present invention is founded on the basic object of providing cosmetic dispensers with dispenser bases and cosmetic insert cartridges that are particularly and differently keyed to one another.

In certain practices of the invention, an object is to provide a line of keyed cosmetic dispensers with differently keyed cosmetic cartridges that are engagable and operable only with correspondingly-keyed dispenser bases.

A further object of embodiments of the invention is to provide a refillable cosmetic dispenser with a keyed dispenser base that prevents the usage of non-matching keyed cosmetic insert cartridges in relation thereto.

A related object of manifestations of the invention is to provide a keyed cosmetic insert cartridge for a refillable cosmetic dispenser that prevents usage of the insert cartridge in relation to non-keyed or differently keyed refillable dispenser bases.

An additional object of embodiments of the invention is to provide a cosmetic insert cartridge that is not operational independently of a dispenser base.

An underlying object of the invention is to provide a refillable cosmetic dispenser and cosmetic insert cartridges for such a refillable cosmetic dispenser that minimize waste thereby to be environmentally sound.

A further object of embodiments of the invention is to provide a keyed dispenser base for a keyed cosmetic dispenser that can be refilled and reused thereby to justify greater investments in luxury relative to the dispenser.

These and further objects, advantages, and details of the present invention will become obvious not only to one who reviews the present specification and drawings but also to those who have an opportunity to make use of an embodiment of the keyed refillable cosmetic dispenser and cosmetic insert cartridges for such cosmetic dispensers disclosed herein. Although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In one embodiment, the invention can be characterized as a keyed refillable cosmetic dispenser for a stick cosmetic with a keyed cosmetic insert cartridge and a keyed dispenser base for receiving the keyed cosmetic insert cartridge. The keyed cosmetic insert cartridge has an elongate body with a proximal end and a distal end, an elevator cup disposed within the elongate body for retaining the stick cosmetic, and a rotary extension and retraction mechanism for selectively adjusting the elevator cup between a retracted position and an extended position relative to the elongate body. The keyed cosmetic insert cartridge and the keyed dispenser base have a matching key pattern combination wherein a key pattern retained by the elongate body matches a key pattern retained by the dispenser base.

In certain embodiments, the elongate body comprises an inner body, and the insert cartridge further comprise a spiral member concentric with the inner body. The inner body has at least one longitudinal track therethrough, the spiral member has at least one spiral formation, and the elevator cup has a sidewall and at least one lug that projects from the sidewall, through the at least one longitudinal track, and into engagement with the at least one spiral formation. Under this construction, the elevator cup can be manipulated between the retracted position and the extended position by a relative rotation between the inner body and the spiral member.

As disclosed herein, the elongate body can have a keyway member, such as a keyway plate, with a keyway with the key pattern formed in the keyway in the keyway member.

Further, the dispenser base can have a key member with the key pattern being formed on the key member. For instance, the key member can comprise a column, and the key pattern can be formed on the column.

According to manifestations of the invention, the key patterns of the cosmetic insert cartridge and the dispenser base can comprise matching patterns of surface deviations that intermesh when the keyed cosmetic insert cartridge is received by the keyed dispenser base such that a rotary driving engagement is established between the keyed dispenser base and the elongate body. For example, the key patterns of the cosmetic insert cartridge and the dispenser base can comprise matching patterns of protuberances and indentations, such as but not limited to matching patterns of ridges and channels. By way of example, the key pattern formed in the keyway of the keyway member can take the form of circumferentially spaced teeth separated by channels, and the key pattern formed on the key member can take the form of plural teeth sized and angularly spaced over the key member to align with and be received into the channels between the teeth of the key pattern of the keyway member. The teeth of the key pattern of the keyway member and the teeth of the key pattern of the key member can have matching pitches, and the teeth of the key pattern of the keyway member can be evenly spaced over 360 angular degrees. Meanwhile, it is disclosed herein that the key pattern of the key member can comprise first and second series of teeth spaced over less than 360 angular degrees, such as with each series of teeth spaced over approximately 90 degrees.

Exploiting the keyed refillable cosmetic dispensers disclosed herein, a line of keyed refillable cosmetic dispensers for stick cosmetics can be provided. The line of cosmetic dispensers can be formed, for example, with first and second keyed refillable cosmetic dispensers, each with a keyed cosmetic insert cartridge with a key pattern and a keyed dispenser base for receiving the cosmetic insert cartridge. The cosmetic insert cartridge and the dispenser base of the first keyed refillable cosmetic dispenser have a matching first key pattern combination wherein the key pattern of the cosmetic insert cartridge matches the key pattern of the dispenser base, and the cosmetic insert cartridge and the dispenser base of the second keyed refillable cosmetic dispenser have a matching second key pattern combination wherein the key pattern of the cosmetic insert cartridge matches the key pattern of the dispenser base. The second key pattern combination is different than the first key pattern combination whereby the key pattern of the cosmetic insert cartridge of the first keyed refillable cosmetic dispenser matches the key pattern of the of the keyed dispenser base of the first keyed refillable cosmetic dispenser but not the key pattern of the keyed dispenser base of the second refillable cosmetic dispenser. It is within the scope of the invention for the line of cosmetic dispensers to include third and further keyed refillable cosmetic dispensers with further, different key pattern combinations.

The foregoing discussion broadly outlines the more important goals and features of the invention to enable a better understanding of the detailed description that follows and to instill a better appreciation of the inventors' contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

The keyed refillable cosmetic dispenser disclosed herein is subject to a variety of embodiments, each within the scope of the invention. However, to ensure that one skilled in the art will be able to understand and, in appropriate cases, practice the present invention, certain preferred embodiments of the broader invention revealed herein are described below and shown in the accompanying drawing figures.

Figure 1:
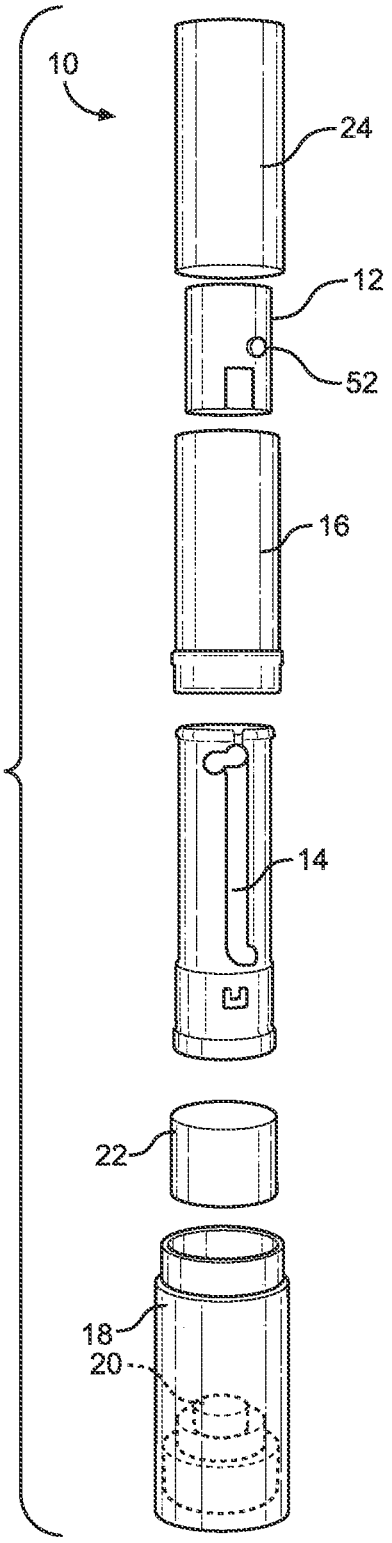
FIG. 1 is an exploded perspective view of a keyed refillable cosmetic dispenser according to the present invention.
Figure 2:
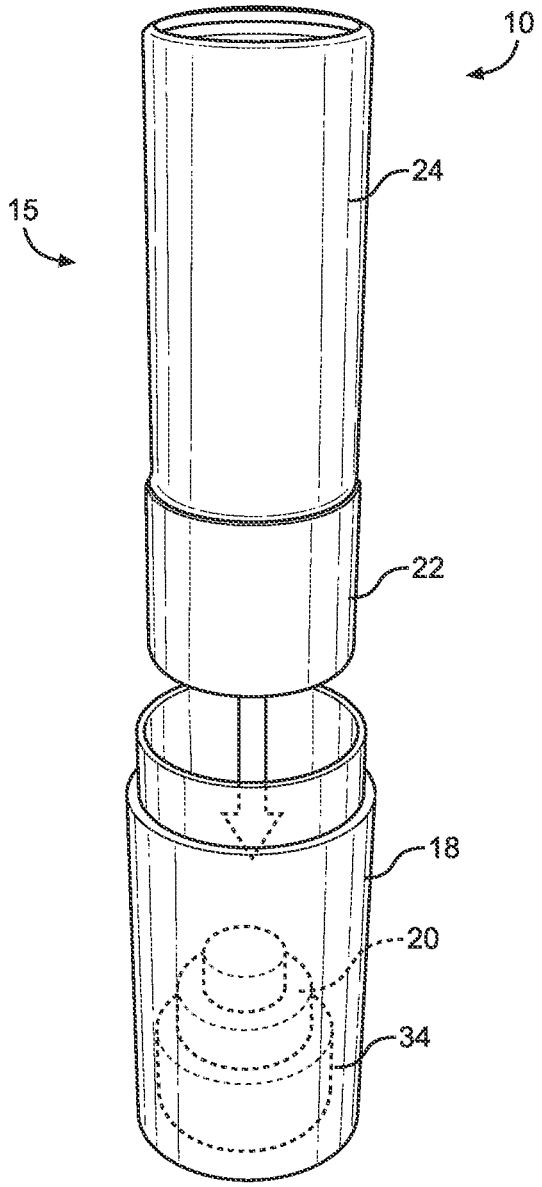
FIG. 2 is a perspective view of a keyed cosmetic cartridge during a stage of assembly with a correspondingly keyed cosmetic base according to the invention.
Figure 3:
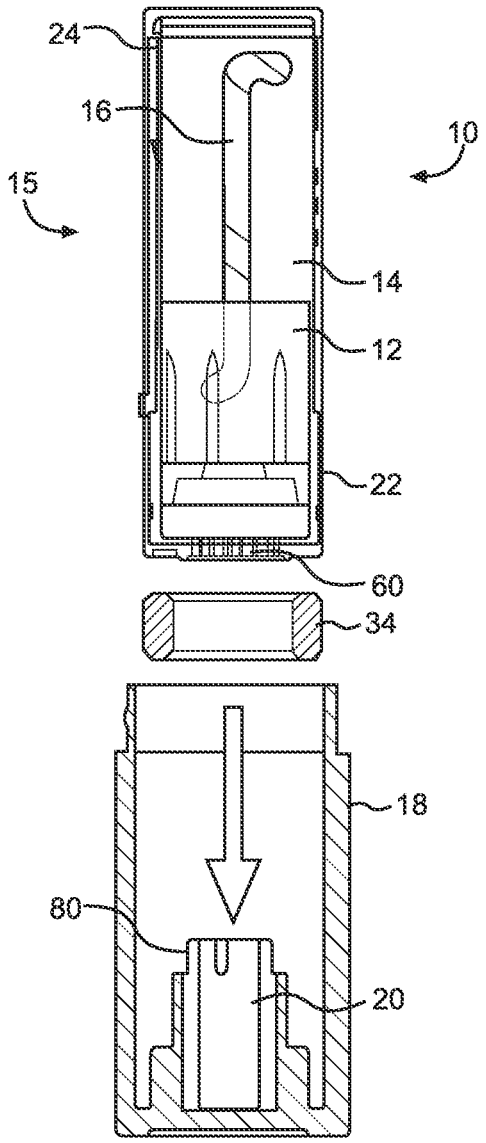
FIG. 3 is a cross-sectional elevational view of the keyed cosmetic cartridge in a stage of assembly with the keyed cosmetic base.
Figure 4:
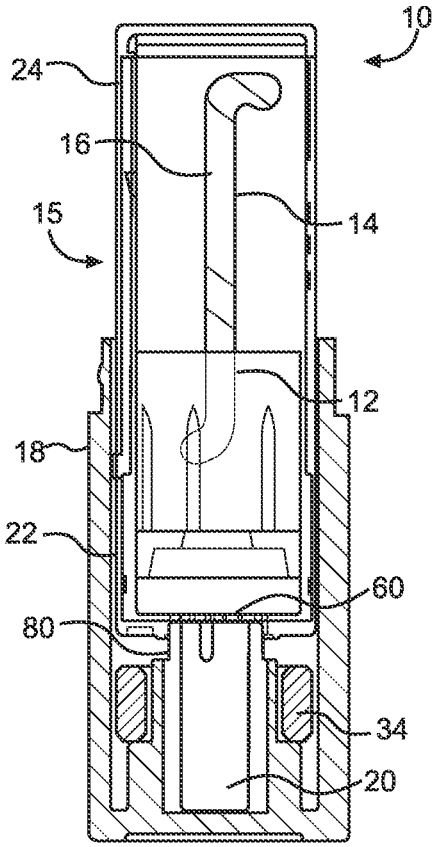
FIG. 4 is a cross-sectional elevational view of the keyed cosmetic cartridge during a further stage of assembly with a keyed cosmetic base as disclosed herein.
Figure 5:
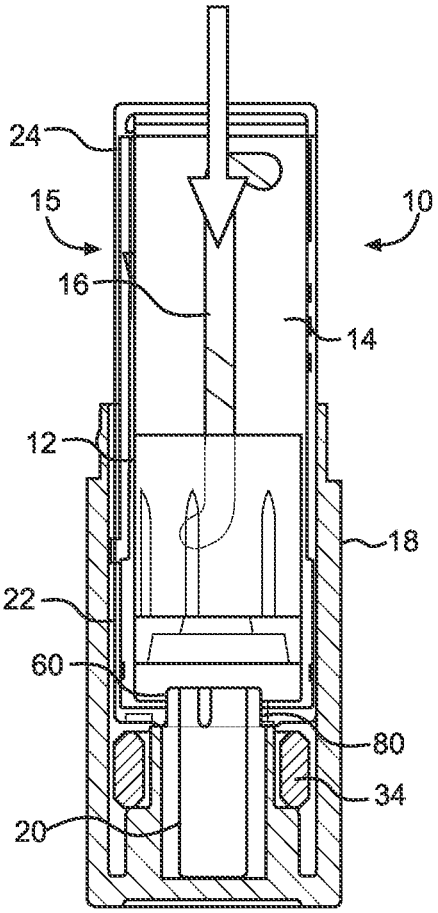
FIG. 5 is a cross-sectional elevational view of the keyed cosmetic cartridge and keyed cosmetic base fully assembled.
Figure 6:
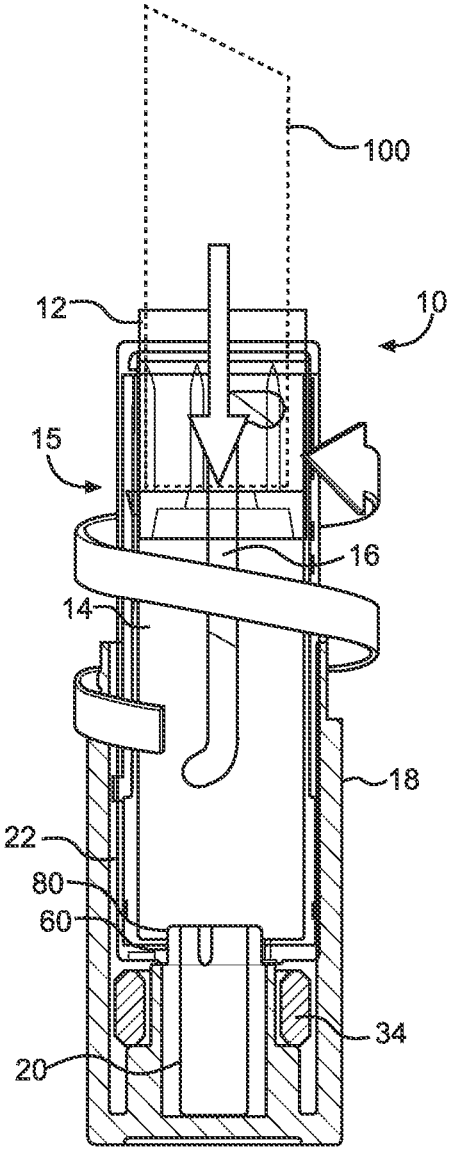
FIG. 6 is a cross-sectional elevational view of the keyed cosmetic cartridge and keyed cosmetic base fully assembled with the elevator cup in an extended position.

Turning more particularly to the drawings, a keyed refillable cosmetic dispenser according to the invention is indicated generally at 10 in FIGS. 1 through 6. The cosmetic dispenser 10 has a tubular inner body 14 that is rotatably engaged with a concentric outer body 16, which may alternatively be referred to as a spiral member 16. An elevator cup 12, which retains a stick cosmetic 100 as shown in FIG. 6 only, is retained to travel longitudinally within the inner body 14. A tubular shell 24, which can be essentially decorative in nature, partially or substantially encases the spiral member 16 and, derivatively, the elevator cup 12 and the inner body 14 disposed therewithin. A lower shell 22 is fixed to encase the proximal portion of the inner body 14. As shown in FIGS. 2 through 6, a keyed cosmetic cartridge 15 is formed when the elevator cup 12, the inner body 14, the spiral member 16, the lower shell 22, and the upper shell 24 are fully assembled. As disclosed herein and as is depicted in the progressive views of FIGS. 1 through 6, the proximal portion of the keyed cosmetic cartridge 15 can be inserted into a correspondingly keyed dispenser base 18 to permit a driving engagement between the keyed dispenser base 18 and the keyed cosmetic cartridge 15.

When a keyed cosmetic cartridge 15 is fully engaged within a correspondingly keyed dispenser base 18, a relative rotation can be produced between the inner body 14 and the spiral member 16, such as by a gripping of the dispenser base 18, a gripping of the upper shell 24, and a relative rotation therebetween. Relative rotation in a first rotational direction, such as in a clockwise direction in the illustrated example, yields an axial extension of the elevator cup 12, and a relative rotation between the inner body 14 and the spiral member 16 in a second, opposite rotational direction yields an axial retraction of the elevator cup 12. Accordingly, when the cartridge 15 and the dispenser base 18 are fully engaged, the elevator cup 12, and thus a retained stick of cosmetic 100, can be selectively adjusted between the retracted disposition depicted, for instance, in FIG. 5 and the extended disposition depicted, for instance, in FIG. 6.

The cosmetic dispenser 10 can be considered to have a proximal end defined as the closed bottom of the dispenser base 18 while the tip of the tubular shell 24 can be considered to define a distal end of the cosmetic dispenser 10. Each component of the cosmetic dispenser 10 can generally be described under that convention. It should be noted that, while terms such as member or the like are employed in relation to the spiral member 16 and possibly other components of the cosmetic dispenser 10, each could be formed unitarily as a single piece of material or from multiple subcomponents joined by any effective method to form the respective structure. Additionally, except as otherwise described or claimed, the elevator cup 12, the inner body 14, the spiral member 16, the components of the dispenser base 18, the tubular shells 22 and 24, and each other component of the cosmetic dispenser 10 can be formed from any suitable material and by any effective method. Although the components of the cosmetic dispenser 10 are not limited as to material, the shells 22 and 24 in one practice of the invention are formed from a rigid material, such as a metal, while the elevator cup 12, the inner body 14, the spiral member 16, and the dispenser base 18 are formed of plastic.

Figure 12:
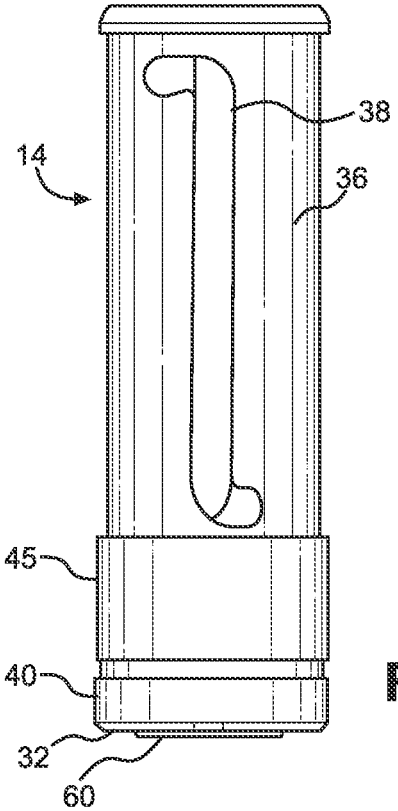
FIGS. 12 and 13 are views in front and rear elevation of a keyed inner body.
Figure 13:
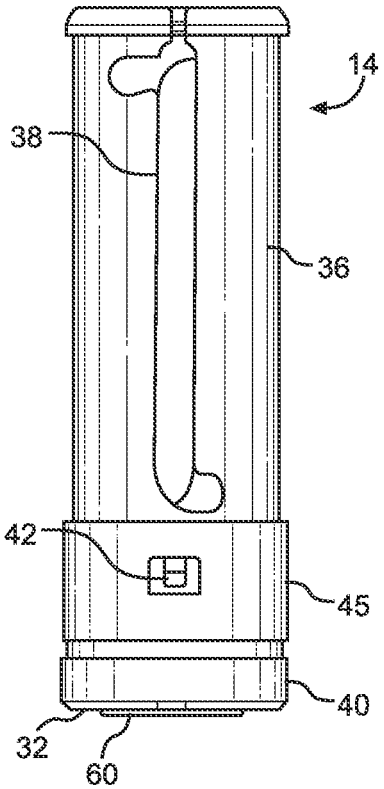
Figure 14:
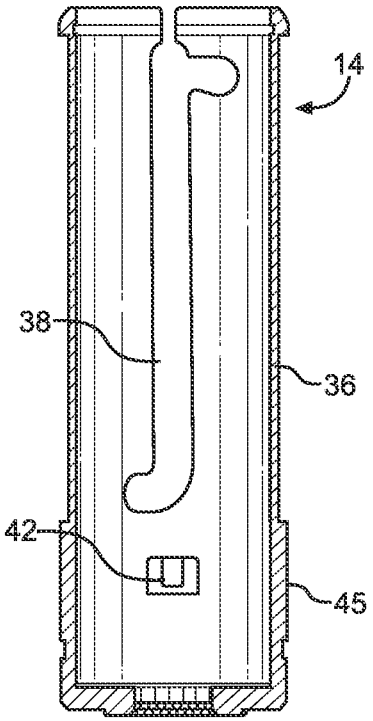
FIG. 14 is a cross-sectional view of the keyed inner body.

One embodiment of the inner body 14 is shown apart from the remainder of the keyed cosmetic dispenser 10 in FIGS. 12 through 14. The inner body 14 has a distally disposed body portion 36 for being received into a body portion 44 of the spiral member 16, which is seen alone in FIGS. 15 through 17. The body portion 36 of the inner body 14 is tubular and has an outer diameter slightly less than the inner diameter of the body portion 44 of the spiral member 16. An annular base portion 40 of the inner body 14 is disposed at a proximal end of the inner body 14, such as by being formed integrally therewith, and a smooth annular bearing wall 45 is interposed between the body portion 36 and the base portion 40. The annular bearing wall 45 is concentric with the inner body 14 and is longitudinally aligned with the body portion 36 and the inner body 14 in general. The annular bearing wall 45 thereby presents what can be referred to as a lateral bearing surface. Lateral force can bear against the annular bearing wall 45.

First and second opposed longitudinal tracks 38 communicate along a substantial length of the body portion 36 of the inner body 14. The longitudinal tracks 38 are disposed in general opposition and pass entirely through the body portion 36 to comprise slots. With this, the elevator lugs 52 of the elevator cup 12, which is shown apart in FIGS. 18 through 21 and is described further hereinbelow, pass through the longitudinal tracks 38 to engage the opposed spiral channels 46 of the spiral member 16 of, for instance, FIGS. 15 through 17. As shown, the first longitudinal track 38 of the inner body 14 can have closed proximal and distal ends while the second longitudinal track 38 can have a closed proximal end and an open distal end for enabling a receipt of the elevator lugs 52 of the elevator cup 12 and for enabling a radial compression of the body portion 36 of the inner body 14 during an insertion of the body portion 36 of the inner body 14 into the body portion 44 of the spiral member 16.

The first and second longitudinal tracks 38 in this embodiment have distal lateral track segments at the distal ends thereof and proximal lateral track segments at the proximal ends thereof. The distal lateral track segments can be employed to lock the elevator cup 12 in an extended disposition, and the proximal lateral track segments lock the elevator cup 12 in a retracted disposition. With this, inadvertent movement, namely unintended extension or retraction, of the elevator cup 12 and the retained cosmetic stick 100 is prevented.

The elevator cup 12 is shown apart from the remainder of the cosmetic dispenser 10 in FIGS. 18 through 21. The elevator cup 12 has an open inner volume for receiving a proximal portion of a member of lipstick (not shown in FIGS. 18 through 21). The open inner volume is defined by an annular peripheral wall 50 and a proximal base portion 56. A plurality of fins 54, each with a proximal end adjacent to the base portion 56, a body portion, and a distal end terminating at a given height along the peripheral wall 50, project radially inward from the peripheral wall 50. In the present embodiment, the fins 54 project along radii of the elevator cup 12, but other angular dispositions are possible. The fins 54 have a distal taper for enabling a most efficient receipt and engagement of the pomade of lipstick. The fins 54 are longitudinally aligned with the elevator cup 12 and the cosmetic dispenser 10 in general. First and second elevator lugs 52 project from opposed sides of the elevator cup 12 from a mid-portion of the peripheral wall 50 for passing through the longitudinal tracks 38 of the inner body 14 to be drivingly engaged with the helical channels 46 of the spiral member 16 as further shown and described herein.

Figure 15:
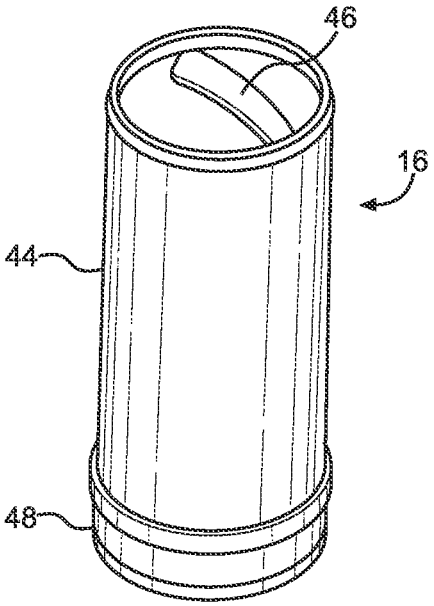
FIG. 15 is a perspective view of a spiral cam pursuant to the invention.
Figure 16:
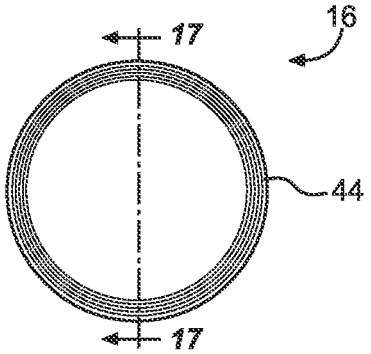
FIG. 16 is a top plan view of the spiral cam.
Figure 17:
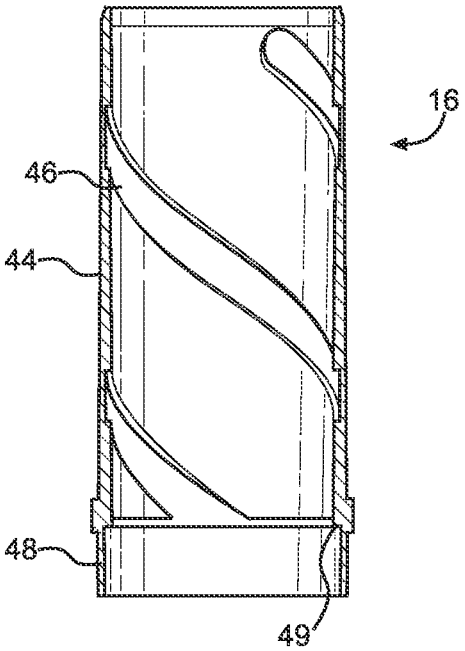
FIG. 17 is a view of the spiral cam in longitudinal cross section taken along the line 17-17 in FIG. 16.
Figure 18:
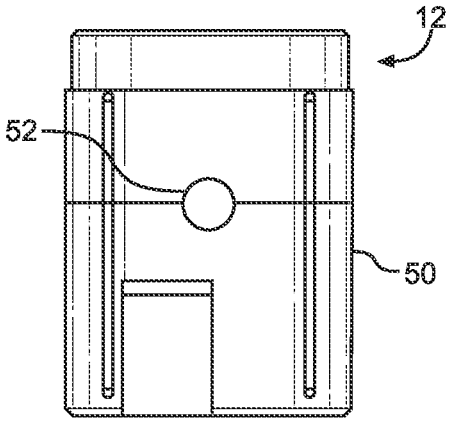
FIG. 18 is a view in front elevation of an elevator cup pursuant to the instant invention.
Figure 19:
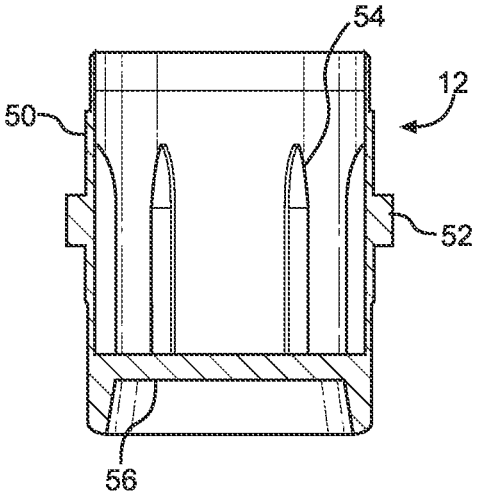
FIG. 19 is a view of the elevator cup in longitudinal cross section taken along the line 19-19 in FIG. 20.
Figure 20:
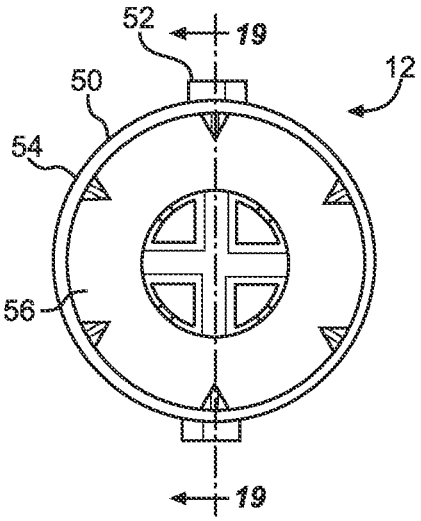
FIGS. 20 and 21 are top and bottom plan views of the elevator cup, respectively.
Figure 21:
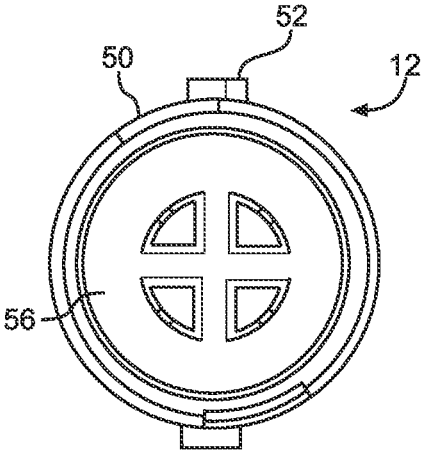
Figure 22:
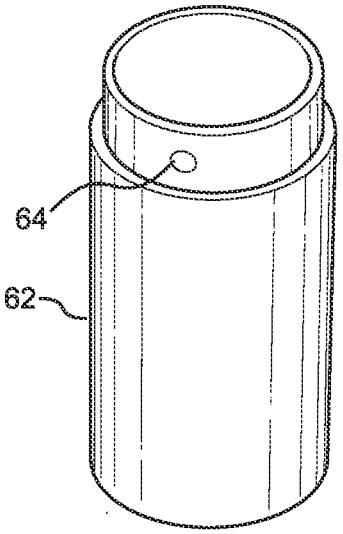
FIG. 22 is a perspective view of a dispenser base according to the present invention.
Figure 23:
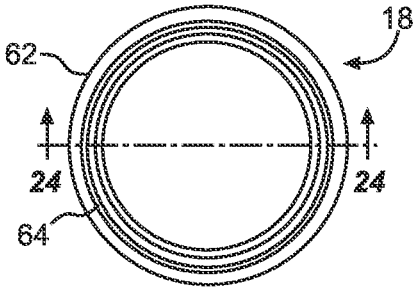
FIG. 23 is a top plan view of the dispenser base.

As shown in FIGS. 15 through 17, the cylindrical spiral member 16 has a proximally disposed skirt 48 and the distally disposed body portion 44. The skirt 48, which is flexible, has an outer diameter greater than the outer diameter of the body portion 44. The tubular upper shell 24 can be disposed to encase the body portion 44 as seen, for example, in FIGS. 2 through 6. The spiral member 16 has an inwardly projecting annular shoulder 49 formed at the distal end of the skirt 48. With that, the inner body 14 can be received through the proximal end of the spiral member 16 until the distal end of the annular bearing wall 45 of the inner body 14 contacts the shoulder 49 of the spiral member 16. The outer shell 24 has an outer diameter approximately equal to the outer diameter of an outer shoulder portion of the skirt 48 and an inner diameter marginally larger than the outer diameter of the body portion 44 of the spiral member 16 whereby a substantially consistent cylindrical outer surface is established along the outer surface of the tubular shell 24 and the outer surface of shoulder portion of the skirt 48.

The inner diameter of the skirt 48 is marginally greater than the outer diameter of the annular bearing wall 45 of the inner body 14. One or more protuberances 42, which in this case comprise the end portions of resiliently deflectable fingers, project radially outward from the annular bearing wall 45 of the inner body 14 to establish a localized effective diameter greater than the undeflected inner diameter of the skirt 48. Under this construction, the protuberances 42 deflect and frictionally engage the skirt 48 thereby to create a frictional engagement between the inner body 14 and the spiral member 16 during a relative rotation therebetween. The pressing of the protuberances 42 against the skirt 48 provides smooth and consistent frictional resistance to the rotation of the inner body 14 relative to the spiral member 16.

Referring again to FIGS. 15 through 17, the body portion 44 of the spiral member 16 has a smooth outer wall surface and an inner wall surface with spiral formations 46, which in this example comprise spiral channels 46, that communicate helically therealong. It will be noted that, although spiral channels 46 are depicted in the instant embodiment, the spiral formations 46 alternatively could comprise spiral threads, spiral ridges, or any other spiral or helical arrangement. As in the present embodiment, first and second spiral channels 46 or other spiral formations 46 are disposed in general opposition to one another thereby to enable the spiral channels 46 to receive and drive the opposed elevator lugs 52 of the elevator cup 12.

The inner diameters of the body portions 36 and 44 of the inner body 14 and the spiral member 16 and the outer diameter of the peripheral wall 50 of the elevator cup 12 are calibrated to allow the elevator cup 12 to slide longitudinally within the inner body 14 and the spiral member 16, such as by having the outer diameter of the peripheral wall 50 be slightly less than the inner diameter of the body portion 36 of the inner body 14. Similarly, the elevator lugs 52 and the opposed spiral channels 46 are dimensioned to enable a sliding of the elevator lugs 52 along the spiral channels 46, such as by having the distance between the outer tips of the elevator lugs 52 slightly less than the distance between the opposed surfaces of the spiral channels 46.

When the cartridge 15 is assembled with the inner body 14 received into the spiral member 16, the skirt 48 of the spiral member 16 extends to surround the distal portion of the annular bearing wall 45 while the proximal portion of the base 40 of the inner body 14 extends proximally beyond the proximal end of the skirt 48 and beyond the spiral member 16 in general. With the proximal portion of the inner body 14 exposed and accessible, it would be possible to rotate the inner body 14 in relation to the spiral member 16 and, in so doing, to extend and retract the elevator cup 12 and a retained cosmetic. With the proximal portion of the base 40 exposed, the cosmetic cartridge 15 could in theory be used and operated independently of a dispenser base 18.

Figure 25:
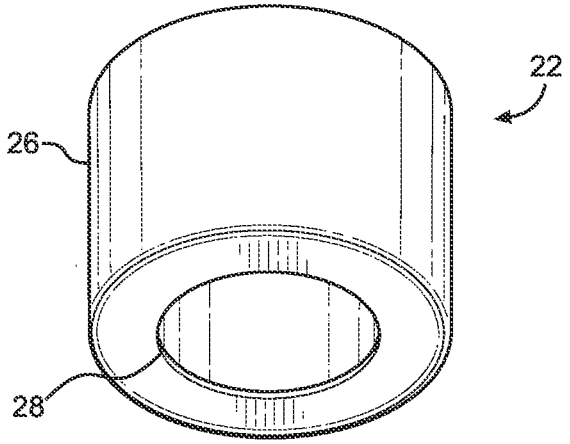
FIG. 25 is a perspective view of a bottom shell as disclosed herein.
Figure 26:
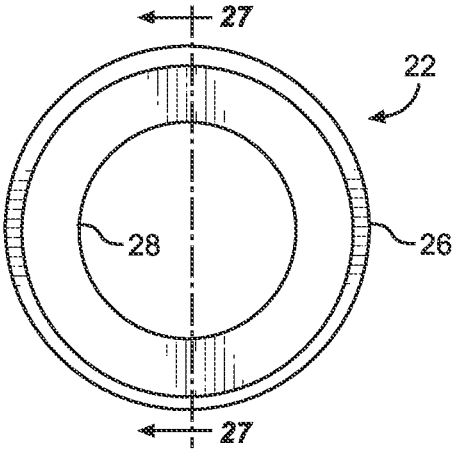
FIG. 26 is a top plan view of the bottom shell.
Figure 27:
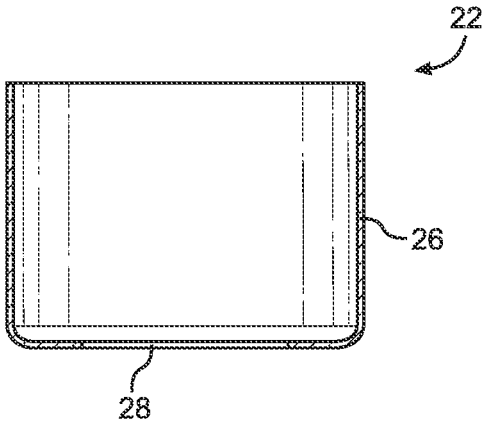
FIG. 27 is a cross-sectional view of the bottom shell taken along the line 27-27 in FIG. 26.
Figure 28:
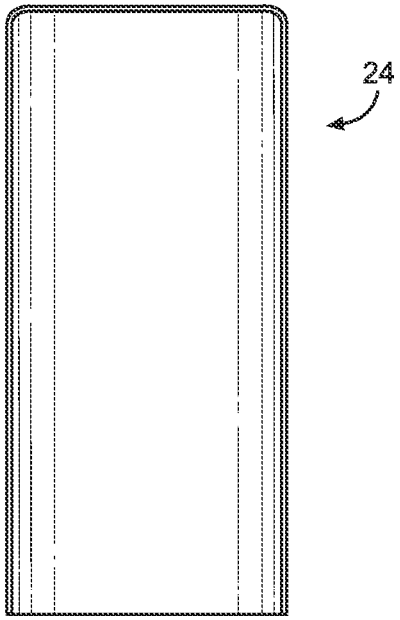
FIG. 28 is a cross-sectional view of the upper shell for the keyed cosmetic cartridge.

According to the present invention, however, the proximal portion of the inner body 14, which would otherwise be exposed and accessible, is encased by the lower shell 22 but for a keyhole opening defined by a bottom ring 28 of the lower shell 22. Looking more particularly to FIGS. 25 through 27, where the shell 22 is shown alone, the lower shell 22 can be seen to have a cylindrical outer wall 26 that retains the bottom ring 28. The bottom ring 28 defines a concentric keyhole opening. The cylindrical outer wall 26 is fit over the skirt 48 of the spiral member 16. Access to the inner body 14 is prevented, except through the keyhole opening.

With further reference to FIGS. 7A through 8C, the inner body 14 can be seen to have a keyway plate 32 in the proximal end of the base portion 40 thereof. A keyway 60 is concentrically disposed within the keyway plate 32. The keyway 60 has a keyway pattern 65 formed therealong. The keyway 60 in the keyway plate 32 and the keyhole opening in the lower shell 22 can thus be considered to define a socket.

The dispenser base 18 retains a concentric key member 20 that is particularly keyed to be received into a keyway 60 of a correspondingly-keyed inner body 14. When the cosmetic dispenser 10 is fully assembled, the key member 20 is fixed within the proximal portion of the elongate tubular member 62 of the dispenser base 18, such as by integral formation or, as here, by being fitted into place. The key member 20 can be fixed in place within the proximal end of the inner body 14, such as but not limited to by a snap-fit engagement, adhesive, sonic welding, or some other method or combination thereof.

Figure 29:
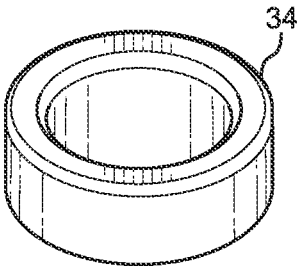
FIG. 29 is a perspective view of a weight for the keyed cosmetic dispenser.

The structure of the key member 20 can be further understood with reference to FIGS. 9A through 9C and 10A through 10C. The key member 20 has a round base plate 72 with a peripheral channel 74 so that the release member 20 can be snap fit or otherwise disposed in engagement with an annular ridge 66 of the dispenser base 18. A central column 78 projects concentrically from the base member 72. A plurality of fins 76 with L-shaped profiles project radially from the central column 78. The L-shaped fins 76, which are four in number in this non-limiting example, establish a shoulder for supporting an annular weight 34, which is shown alone in FIG. 29. The central column 78 projects beyond the fins 76 to have a key tip 84. An annular shoulder is disposed at the proximal end of the key tip 84. First and second opposed resilient fingers 82 with radially projecting protuberances are interposed as portions of the key tip 84 whereby the fingers 82 can be snapped through the keyway 60 of the keyway plate 32 of the inner body 14 to retain the key member 20 and the dispenser base 18 and the cosmetic cartridge 15 in relation to one another. The key tip 84 has a key pattern 80 formed therealong.

For the key member 20 of the dispenser base 18 to be matingly received into the keyway 60 of the cosmetic cartridge 15, the key pattern 80 of the key member 20 must match the key pattern 65 of the keyway plate 32. The key patterns 65 and 80 comprise patterns of surface deviations spaced along the inner periphery of the keyway 60 and along the outer periphery of the key tip 84. In certain embodiments, when viewed in plan along the longitudinals of the cosmetic cartridge 15 and the dispenser base 18, the key patterns 65 and 80 can be characterized as comprising series or patterns of ridges, ribs, or other protuberances, potentially separated by channels, furrows, or other lowered sections or indentations. The key patterns 65 and 80 are formed to complement one another to permit the key tip 84 to be received into the keyway 60 with the key patterns 65 and 80 intermeshed. When the key patterns 65 and 80 are intermeshed, a driving engagement is established between the dispenser base 18 and the inner body 14.

Figure 9A:
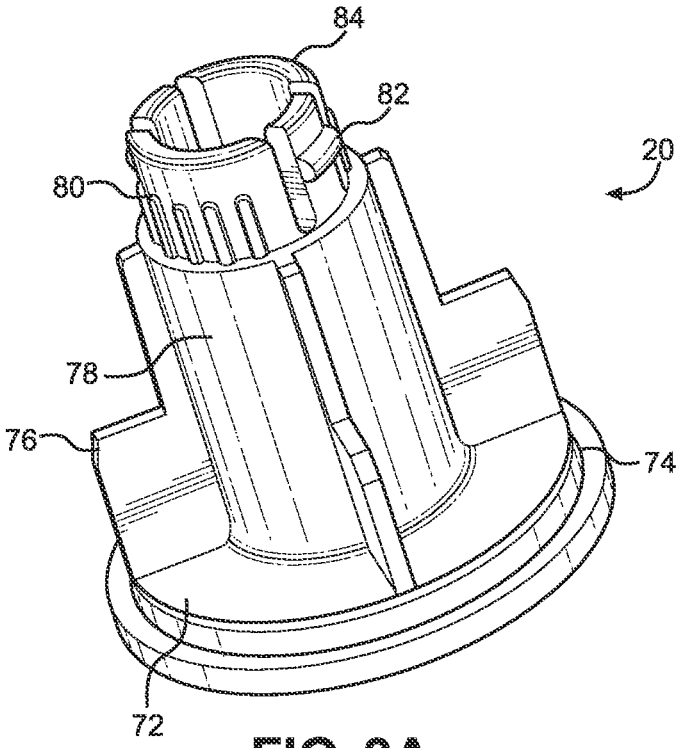
FIGS. 9A, 9B, and 9C are perspective views of center posts differently keyed in correspondence to the inner bodies of FIGS. 7A, 7B, and 7C, respectively.
Figure 9B:
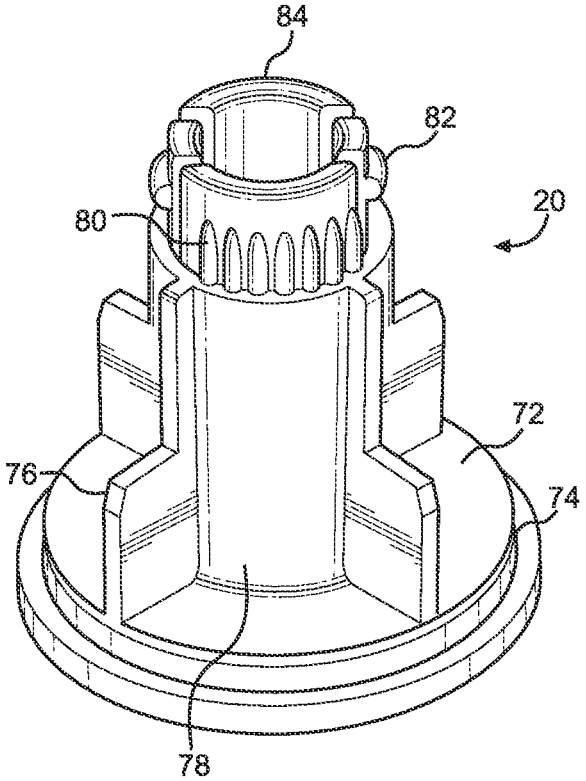
Figure 9C:
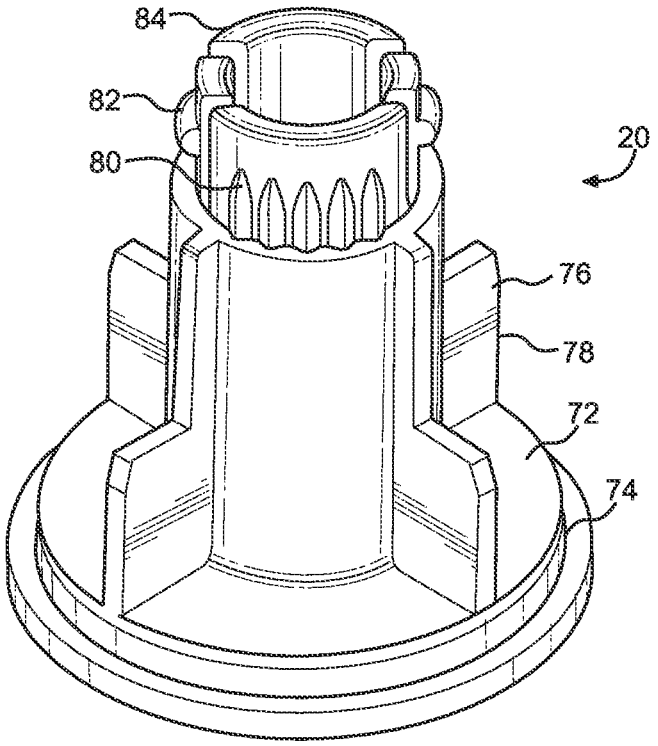
Figure 10A:
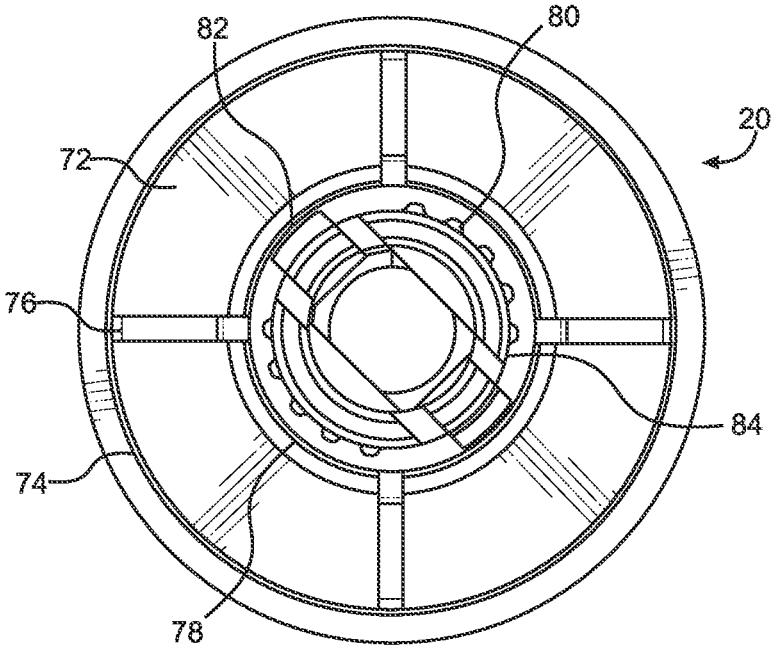
FIGS. 10A, 10B, and 10C are top plan views of the keyed center posts of FIGS. 9A, 9B, and 9C, respectively.
Figure 10B:
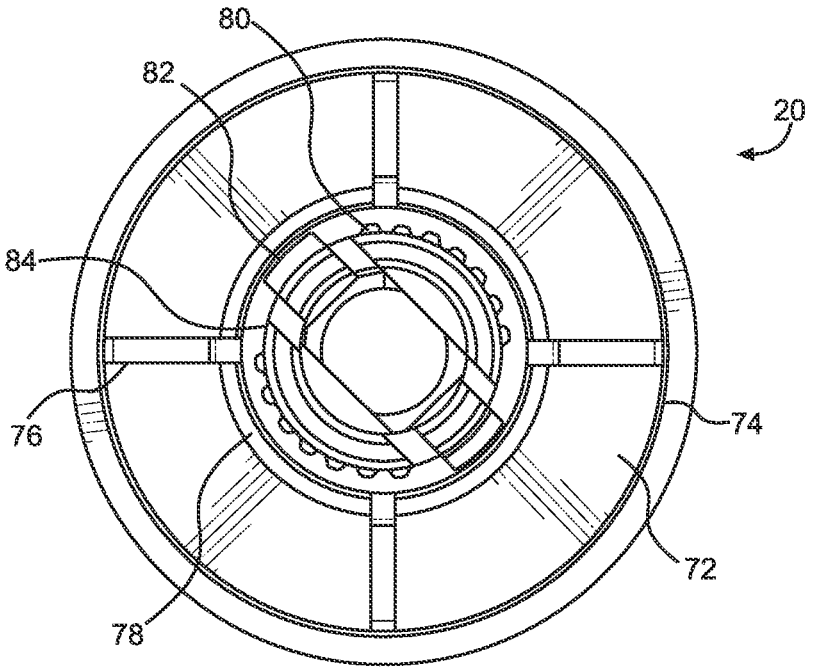
Figure 10C:
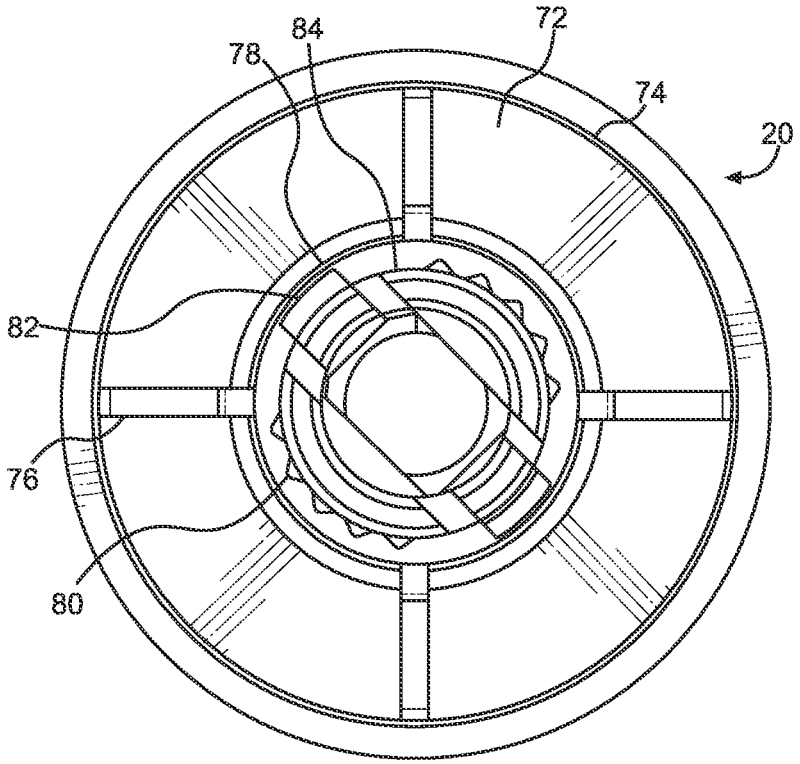
Figure 11:
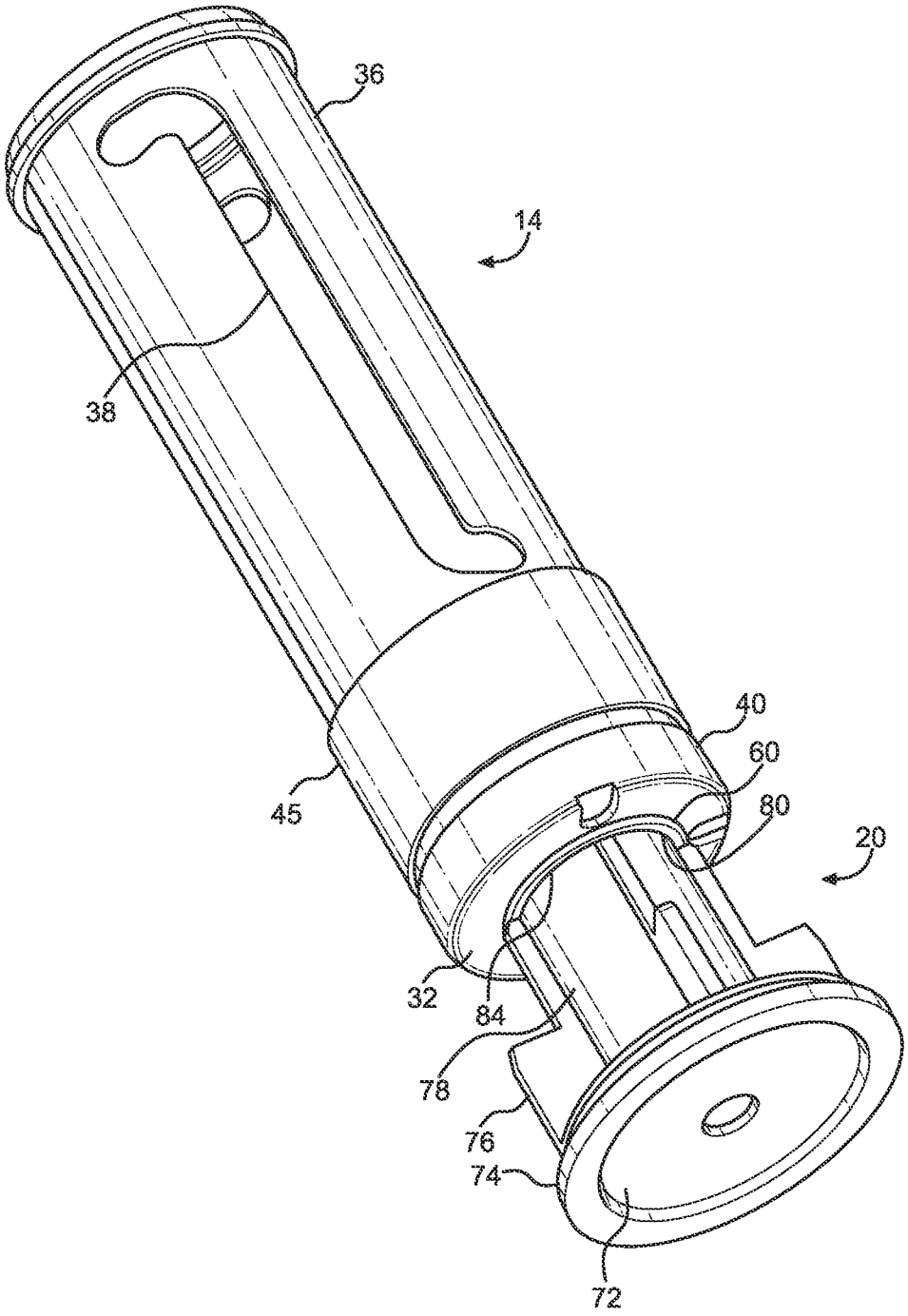
FIG. 11 is a perspective view of a keyed center post according to the invention engaged with a correspondingly keyed inner body.

The scope of the invention is not limited to any particular pattern type or to any specific key patterns 65 and 80. A number of illustrative but not limiting key patterns 65 and 80 are shown and described herein. A first key pattern combination is depicted in FIGS. 7A, 8A, 9A, and 10A. The embodiment of the inner body 14 of FIGS. 7A and 8A has a keyway plate 32 that is keyed with a key pattern 65 formed as that of an internal spur gear with evenly circumferentially spaced cog teeth separated by evenly spaced channels. The key member 20 illustrated in FIGS. 9A and 10A is particularly keyed with a key pattern 80 configured to intermesh with and drivingly engage the key pattern 65 of the inner body 14 of FIGS. 7A and 8A. As such, the key pattern 80 of the key member 20 is formed with plural teeth that are sized and angularly spaced over portions of the circumference of the key tip 84 to align with and be received into the channels between the cog teeth of the key pattern 65 and with spaces between the teeth for receiving the cog teeth of the key pattern 65. The teeth of the key tip 84 and of the keyway plate 32 have matching pitches. In the depicted embodiment, the key pattern 65 of the inner body 14 spans a continuous 360 degrees while the key pattern 80 of the key member 20 is formed with two series of teeth spaced over approximately 90 degrees, but this is not limiting.

Figure 7A:
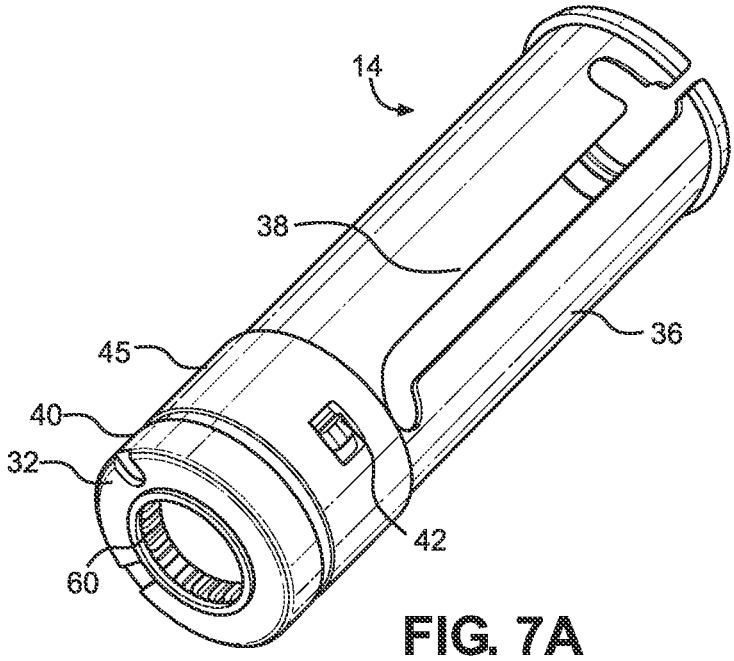
FIGS. 7A, 7B, and 7C are perspective view of differently keyed inner bodies pursuant to the instant invention.
Figure 7B:
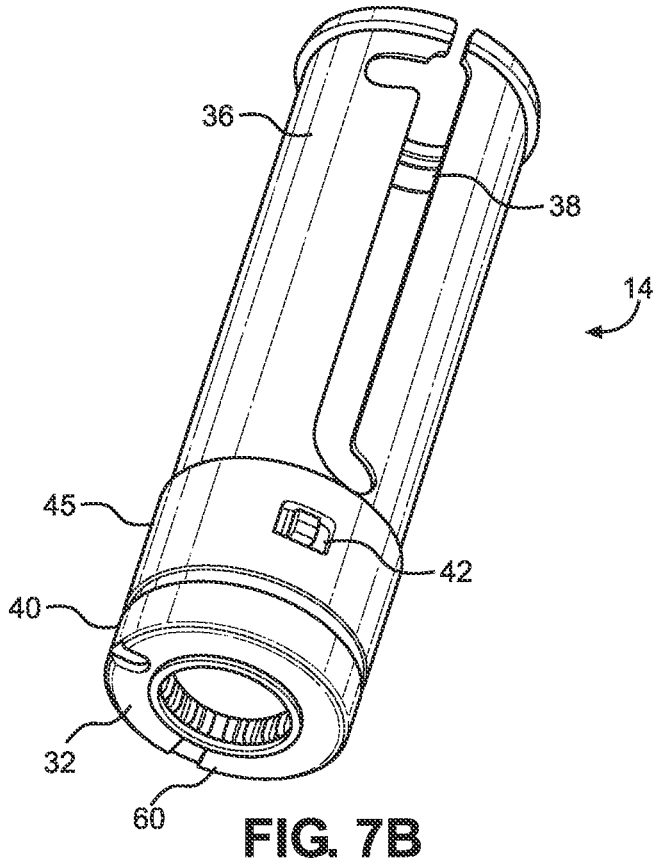
Figure 7C:
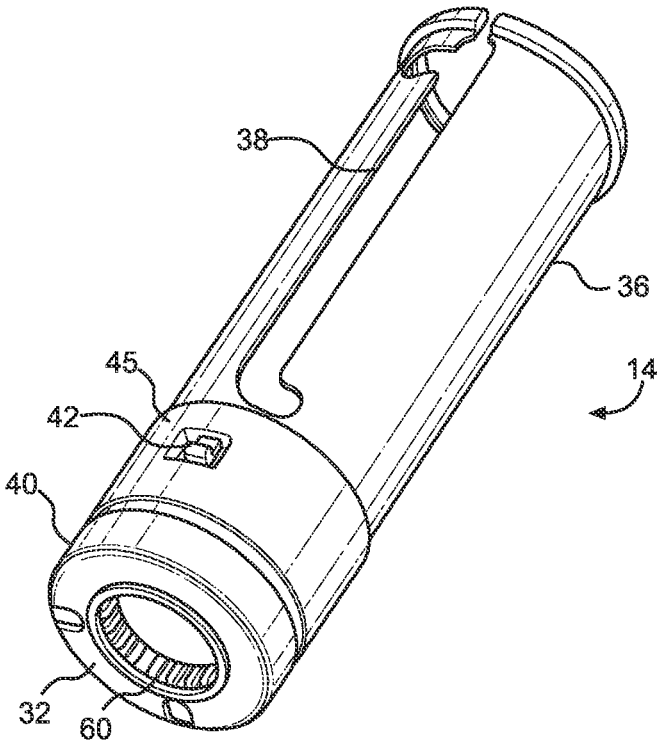
Figure 8A:
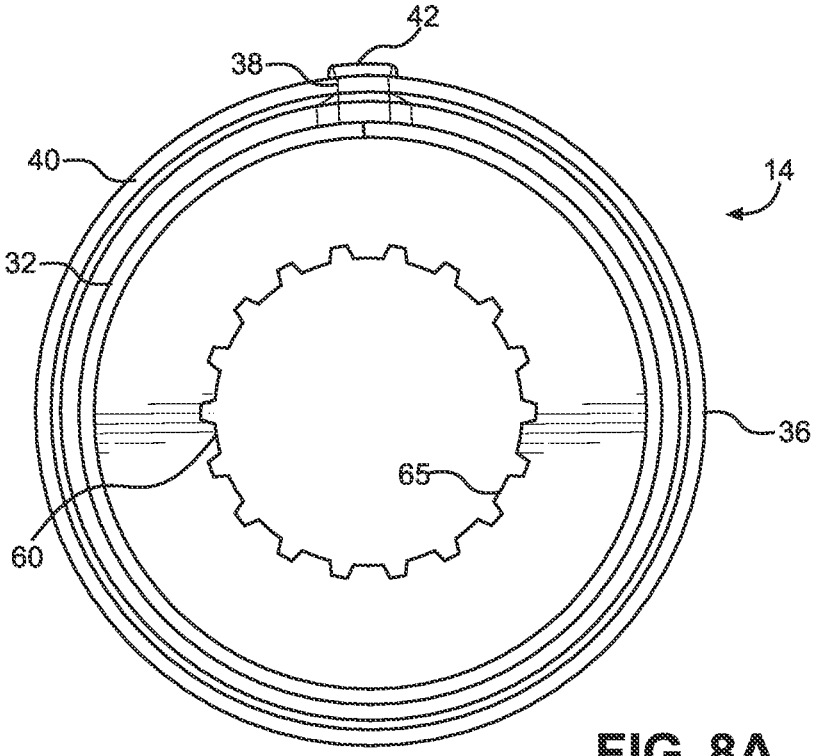
FIGS. 8A, 8B, and 8C are top plan views of the inner bodies of FIGS. 7A, 7B and 7C, respectively.
Figure 8B:
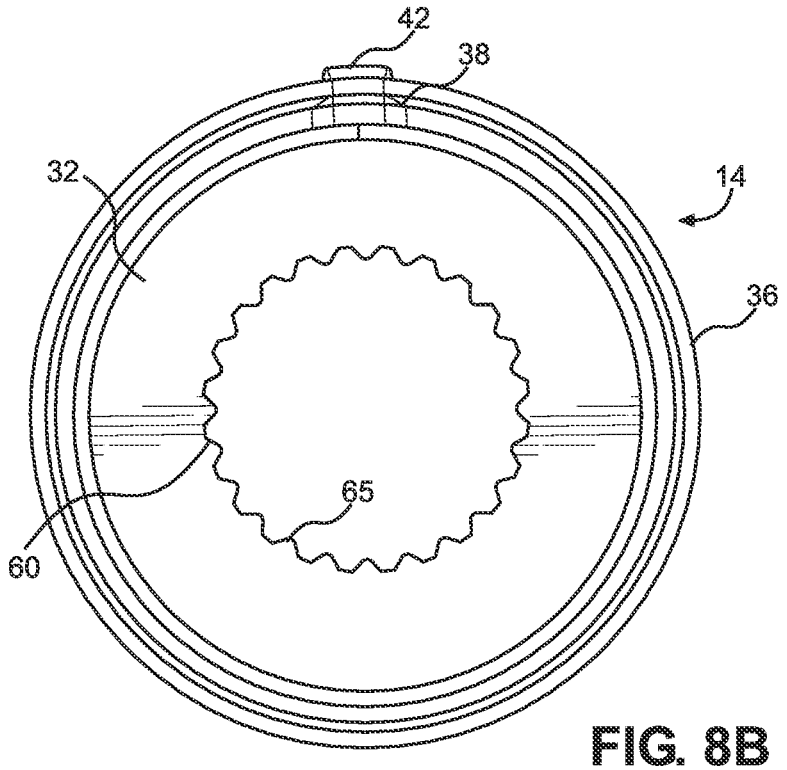
Figure 8C:
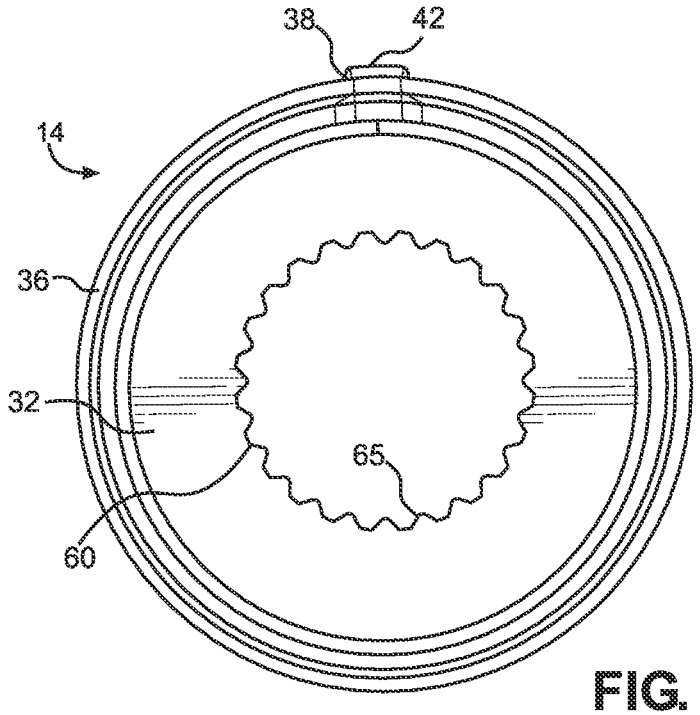

Another key pattern combination is illustrated in FIGS. 7B, 8B, 9B, and 10B. In FIGS. 7B and 8B, an embodiment of the inner body 14 is shown with a keyway plate 32 that is keyed to have a key pattern 65 of evenly circumferentially spaced saw teeth shapes that are separated by evenly spaced channels. The matching key member 20 of FIGS. 9B and 10B has a key pattern 80 configured to intermesh with and drivingly engage the key pattern 65 of the inner body 14 of FIGS. 7B and 8B. As such, the key pattern 80 of the key member 20 has plural saw teeth shapes that are sized and angularly spaced over portions of the circumference of the key tip 84 with a matching pitch to align with and be received into the channels between the saw teeth of the key pattern 65 and with spaces between the teeth for receiving the saw teeth shapes of the key pattern 65. Again in the present non-limiting embodiment, the key pattern 65 of the inner body 14 spans a continuous 360 degrees while the key pattern 80 of the key member 20 is formed with two series of teeth spaced over approximately 90 degrees.

Turning to FIGS. 7C, 8C, 9C, and 10C, a further key pattern combination is illustrated. There, the inner body 14 again has a keyway plate 32 keyed to have a key pattern 65 of evenly circumferentially spaced saw teeth shapes separated by evenly spaced channels. The key member 20 of FIGS. 9C and 10C has a matching key pattern 80 configured to intermesh with and drivingly engage the key pattern 65 of the inner body 14 of FIGS. 7C and 8C. The key pattern 80 of the key member 20 thus has plural saw teeth shapes that are sized and angularly spaced over portions of the circumference of the key tip 84 with a matching pitch to align with and be received into the channels between the saw teeth of the key pattern 65 and with spaces between the teeth for receiving the saw teeth shapes of the key pattern 65. As before, the key pattern 65 of the inner body 14 spans a continuous 360 degrees while the key pattern 80 of the key member 20 is formed with two series of teeth spaced over approximately 90 degrees. In the present embodiment, however, the saw teeth of the key patterns 65 and 80 are disposed at a different pitch than the pitch of the key patterns 65 and 80 of the embodiment of FIGS. 7B, 8B, 9B, and 10B. While the embodiment of the inner body 14 of FIGS. 7C and 8C has twenty teeth spaced at a pitch of 18 degrees, the embodiment of the inner body 14 of FIGS. 7B and 8B has 24 teeth spaced at a pitch of 15 degrees. Moreover, the teeth of the embodiment of FIGS. 7B, 8B, 9B, and 10B have different face angles in comparison to the teeth of the embodiment of FIGS. 7C, 8C, 9C, and 10C. As such, the key member 20 of the embodiment of FIGS. 7B, 8B, 9B, and 10B is incorrect for the inner body 14 of the embodiment of FIGS. 7C, 8C, 9C, and 10C and cannot be received therein. Similarly, the key member 20 of the embodiment of FIGS. 7C, 8C, 9C, and 10C is incorrect for the inner body 14 of the embodiment of FIGS. 7B, 8B, 9B, and 10B and cannot be received therein.

By virtue of the key patterns 65 and 80 of the inner body 14 and the dispenser base 18, a refillable cosmetic dispenser 10 is thus provided wherein the dispenser base 18 and the cosmetic insert cartridge 15 are particularly keyed to one another with matching key patterns 65 and 80. A series of different, matching key patterns 65 and 80 can be established to provide a line of keyed cosmetic dispensers 10 with different key pattern combinations, each key pattern combination resulting in a keyed cosmetic cartridge 15 that is engagable and operable only with the correspondingly-keyed dispenser base 18 of that key pattern combination. The ability to provide individually keyed refillable cosmetic dispensers 10 could be exploited, by way of example and not limitation, to enable a producer of cosmetic dispensers 10 to key one model of the keyed cosmetic dispenser 10 specific to one cosmetic manufacturer or specific to one cosmetic line of a given manufacturer, such as with the key pattern combination shown in FIGS. 7A, 8A, 9A, and 10A, while keying a second model of the keyed cosmetic dispenser 10 specific to a second cosmetic manufacturer or specific to a second cosmetic line of a manufacturer, such as with the key pattern combination of FIGS. 7B, 8B, 9B, and 10B and keying a third model of the keyed cosmetic dispenser 10 specific to a third cosmetic manufacturer or specific to a third cosmetic line of a manufacturer, such as with the key pattern combination of FIGS. 7C, 8C, 9C, and 10C.

The type and number of key pattern combinations are essentially limitless. Matching key patterns 65 and 80 can be created, by way of example and not limitation, by varying the shape, size, number, or other structural characteristic of surface deviations establishing the key patterns 65 and 80. The resulting keyed cosmetic dispensers 10 prevent the usage of non-matching keyed cosmetic insert cartridges 15 in relation to particularly keyed cosmetic dispenser bases 18. Moreover, cosmetic insert cartridges 15 keyed as taught herein prevent usage of the insert cartridge 15 in relation to non-keyed or differently keyed refillable dispenser bases 18. Still further, by virtue of the encasing lower shell 22, the assembled cosmetic insert cartridge 15 is not operational independently of a dispenser base 18.

In practice, the cosmetic insert cartridge 15 can be assembled as in FIGS. 1 through 6 with the elevator cup 12 concentrically disposed within the inner body 14. The inner body 14 is concentrically disposed within the spiral member 16 with the lugs 52 of the elevator cup 12 received within the spiral channels 46 of the spiral member 16. The cylindrical shell 24, commonly referred to as an A-shell, is disposed to encase the spiral member 16. The lower shell 22 is installed to receive the proximal end of the spiral member 16 and to encase the protruding proximal portion of the inner body 14. To be rendered operational, the keyed cosmetic cartridge 15 must be engaged with a dispenser base 18 with a matching key pattern 80. The key tip 84 of the keyed dispenser base 18 thus effectively unlocks the keyed cosmetic insert cartridge 15 by uniquely intermeshing only with the correspondingly-keyed cosmetic cartridge 15.

Figure 24:
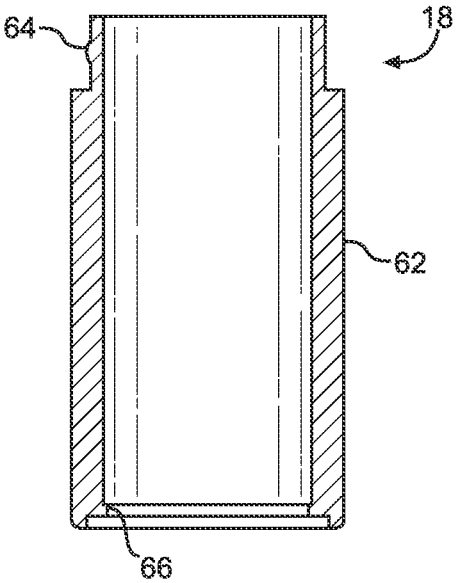
FIG. 24 is a cross-sectional view of the dispenser base taken along the line 24-24 in FIG. 23.
Figure 30:
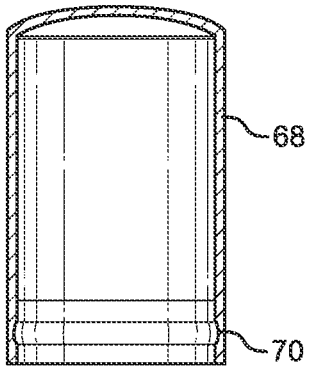
FIG. 30 is a view of a cap of the keyed cosmetic dispenser in longitudinal cross section.
Figure 31:
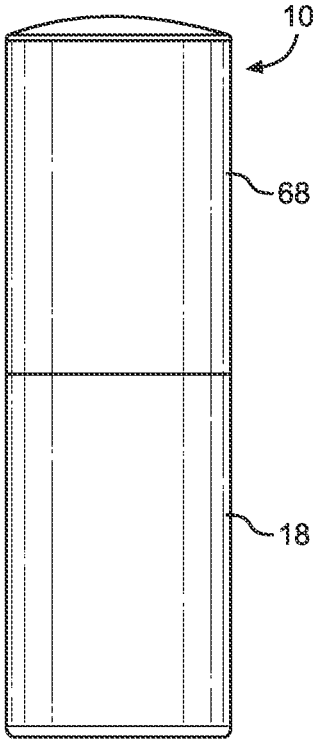
FIG. 31 is a view in front elevation of the keyed cosmetic dispenser in fully assembled form.

A dispenser cap 68 as shown in FIG. 30 can be snapped in place atop the dispenser base 18 as in FIG. 31. As FIGS. 24 and 30 show, the dispenser base 18 has one or more protuberances 64 for engaging a channel 70 along the inner surface of the dispenser cap 68 to retain the dispenser base 18 and the dispenser cap 68 in engagement.

When a keyed cosmetic cartridge 15 is engaged with a matching keyed dispenser base 18, the elevator cup 12, the inner body 14, and the spiral member 16 cooperate to form a rotary extension and retraction mechanism. By the engagement of the release member 20 with the locking member 22, the inner body 14 is rotationally fixed relative to the dispenser base 18, and the upper shell 24 is rotationally fixed relative to the spiral member 16. The inner body 14 can then be manually rotated in relation to the spiral member 16 by, for instance, a gripping of the keyed dispenser base 18 and a relative rotation of the base 18 and the shell 24. The elevator cup 12, and thus a lipstick member 100 retained by the elevator cup 12 as in FIG. 6, can be manipulated between the retracted configuration depicted in FIG. 5 and the extended configuration depicted in FIG. 6 by a rotation of the inner body 14 in relation to the spiral member 16.

As the inner body 14 is rotated in relation to the spiral member 16, the elevator cup 12 is prevented from rotating in relation to the inner body 14 by engagement of the lugs 52 with the longitudinal tracks 38 of the inner body 14. With that, the lugs 52 of the elevator cup 12 slide along the helical channels 46 of the spiral member 16 to yield an axial movement of the elevator cup 12 and the retained lipstick 100. Relative rotation in a first direction will induce an extension of the elevator cup 12 while relative rotation in a second, opposite direction will induce a retraction of the elevator cup 12 and the retained cosmetic stick 100. When desired, such as when a given stick cosmetic 100 is spent or when a different color or type of cosmetic 100 is desired, a user can disengage the keyed cosmetic cartridge 15 retaining the cosmetic 100 to be replaced from the keyed dispenser base 18. A different, but again correspondingly-keyed, cosmetic insert cartridge 15 into the cosmetic base 18.

It will be understood that terms of orientation may be referenced herein merely provide a complete understanding of the disclosed keyed refillable cosmetic dispenser 10 and are not limiting of the invention. Other nomenclature and conventions may be used without limitation of the teachings herein. Furthermore, the various components disclosed herein are merely illustrative and are not limiting of the invention. For example, except as limited by the claims, each of the components discussed herein may include subcomponents that collectively provide for the structure and function of the disclosed component. Furthermore, one or more components, sometimes referred to as members or otherwise herein, could be combined as a unitary structure while still corresponding to the disclosed components. Additional components that provide additional functions, or enhancements to those introduced herein, may be included. For example, additional components and materials, combinations of components or materials, and perhaps the omission of components or materials may be used to create embodiments that are nonetheless within the scope of the teachings herein.

When introducing elements of the present invention or embodiments thereof, the articles "a," "an," and "the" are intended to mean that there are one or more of the elements. The terms "comprising," "including," and "having" are intended to be inclusive such that there may be additional elements other than the listed elements. As used herein, the term "example" or "exemplary" is not intended to imply a superlative example. Rather, "exemplary" refers to an embodiment that is one of many possible embodiments.

With certain details and embodiments of the present invention for a keyed refillable cosmetic dispenser 10 disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims shall define the scope of protection to be afforded to the invention. Those claims shall be deemed to include equivalent constructions insofar as they do not depart from the spirit and scope of the invention. It must be further noted that a plurality of the following claims may express, or be interpreted to express, certain elements as means for performing a specific function, at times without the recital of structure or material. As the law demands, any such claims shall be construed to cover not only the corresponding structure and material expressly described in this specification but also all legally cognizable equivalents thereof.

We claim as deserving the protection of Letters Patent:

1. A keyed refillable cosmetic dispenser for a stick cosmetic, the cosmetic dispenser comprising:

a keyed cosmetic insert cartridge comprising an elongate body with a proximal end and a distal end, an elevator cup disposed within the elongate body for retaining the stick cosmetic, and a rotary extension and retraction mechanism for selectively adjusting the elevator cup between a retracted position and an extended position relative to the elongate body wherein the elongate body retains a key pattern; and a keyed dispenser base for receiving the keyed cosmetic insert cartridge wherein the dispenser base retains a key pattern;

wherein the keyed cosmetic insert cartridge and the keyed dispenser base have a matching key pattern combination wherein the key pattern retained by the elongate body matches the key pattern retained by the dispenser base;

wherein the key patterns of the cosmetic insert cartridge and the dispenser base comprise matching patterns of ridges and channels that intermesh when the keyed cosmetic insert cartridge is received by the keyed dispenser base whereby a rotary driving engagement is established between the keyed dispenser base and the elongate body;

wherein the elongate body has a keyway member with a keyway, wherein the key pattern of the cosmetic insert cartridge is formed in the keyway in the keyway member, wherein the dispenser base has a key member, and wherein the key pattern of the dispenser base is formed on the key member;

wherein the key pattern formed in the keyway of the keyway member comprises circumferentially spaced teeth separated by channels and wherein the key pattern formed on the key member comprises plural teeth sized and angularly spaced over the key member to align with and be received into the channels between the teeth of the key pattern of the keyway member.

2. The keyed refillable cosmetic dispenser of claim 1 wherein the elongate body comprises an inner body and further comprising a spiral member concentric with the inner body wherein the inner body has at least one longitudinal track therethrough, wherein the spiral member has at least one spiral formation, and wherein the elevator cup has a sidewall and at least one lug that projects from the sidewall, through the at least one longitudinal track, and into engagement with the at least one spiral formation whereby the elevator cup can be manipulated between the retracted position and the extended position by a relative rotation between the inner body and the spiral member.

3. The keyed refillable cosmetic dispenser of claim 1 wherein the key member comprises a column and wherein the key pattern is formed on the column.

4. The keyed refillable cosmetic dispenser of claim 1 wherein the teeth of the key pattern of the keyway member and the teeth of the key pattern of the key member have matching pitches.

5. The keyed refillable cosmetic dispenser of claim 4 wherein the teeth of the key pattern of the keyway member are spaced over 360 angular degrees.

6. The keyed refillable cosmetic dispenser of claim 5 wherein the teeth of the key pattern of the keyway member are evenly spaced.

7. The keyed refillable cosmetic dispenser of claim 5 wherein the key pattern of the key member comprises at least one series of teeth spaced over less than 360 angular degrees.

8. The keyed refillable cosmetic dispenser of claim 1 wherein the key pattern formed on the key member of the dispenser base comprises at least two series of teeth each spaced over less than 180 degrees.

9. The keyed refillable cosmetic dispenser of claim 8 wherein the key pattern formed on the key member of the dispenser base comprises two series of teeth each spaced over approximately 90 degrees.

10. A keyed refillable cosmetic dispenser for a stick cosmetic, the cosmetic dispenser comprising:

a keyed cosmetic insert cartridge comprising an inner body with a proximal portion and a distal portion, an elevator cup disposed within the inner body for retaining the stick cosmetic, an outer body concentric with the inner body wherein the outer body has a proximal portion and a distal portion, and a rotary extension and retraction mechanism for selectively adjusting the elevator cup between a retracted position and an extended position relative to the inner body by a relative rotation between the inner body and the outer body;

a key pattern disposed in the proximal portion of the inner body;

a keyed dispenser base for receiving the keyed cosmetic insert cartridge wherein the dispenser base has a key member comprising a central column;

a key pattern disposed on the central column of the dispenser base;

wherein the keyed cosmetic insert cartridge and the keyed dispenser base have a matching key pattern combination wherein the key pattern disposed in the proximal portion of the inner body matches the key pattern disposed on the central column of the dispenser base whereby a rotary driving engagement can be established between the keyed dispenser base and the inner body;

wherein the key patterns of the cosmetic insert cartridge and the dispenser base comprise matching patterns of ridges and channels that intermesh when the keyed cosmetic insert cartridge is received by the keyed dispenser base;

wherein the inner body has a keyway member with a keyway, wherein the key pattern is formed in the keyway in the keyway member, wherein the key pattern formed in the keyway of the keyway member comprises circumferentially spaced teeth separated by channels, and wherein the key pattern disposed on the central column of the dispenser base comprises plural teeth sized and angularly spaced over the central column to align with and be received into the channels between the teeth of the key pattern of the keyway member.

11. The keyed refillable cosmetic dispenser of claim 10 wherein the outer body comprises a spiral member, wherein the inner body has at least one longitudinal track therethrough, wherein the spiral member has at least one spiral formation, and wherein the elevator cup has a sidewall and at least one lug that projects from the sidewall, through the at least one longitudinal track, and into engagement with the at least one spiral formation whereby the elevator cup can be manipulated between the retracted position and the extended position by a relative rotation between the inner body and the spiral member.

12. The keyed refillable cosmetic dispenser of claim 10 wherein the teeth of the key pattern of the keyway member and the teeth of the key pattern of the key member have matching pitches.

13. The keyed refillable cosmetic dispenser of claim 10 wherein the proximal portion of the inner body extends proximally beyond the proximal portion of the outer body and further comprising a shell with an outer wall and a bottom ring with a keyhole opening wherein the outer wall of the shell is received over the proximal portion of the outer body, wherein the proximal portion of the inner body is encased by the shell, and wherein access to the key pattern of the inner body is provided through the keyhole opening in the bottom ring of the shell.

14. The keyed refillable cosmetic dispenser of claim 10 wherein the key pattern formed on the key member of the dispenser base comprises at least two series of teeth each spaced over less than 180 degrees.

15. The keyed refillable cosmetic dispenser of claim 14 wherein the key pattern formed on the key member of the dispenser base comprises two series of teeth each spaced over approximately 90 degrees.

16. A line of keyed refillable cosmetic dispensers for stick cosmetics, the line of cosmetic dispensers comprising:

a first keyed refillable cosmetic dispenser comprising a keyed cosmetic insert cartridge with a key pattern and a keyed dispenser base for receiving the cosmetic insert cartridge, wherein the dispenser base has a key pattern, wherein the cosmetic insert cartridge and the dispenser base have a matching first key pattern combination wherein the key pattern of the cosmetic insert cartridge matches the key pattern of the dispenser base; and a second keyed refillable cosmetic dispenser comprising a keyed cosmetic insert cartridge with a key pattern and a keyed dispenser base for receiving the cosmetic insert cartridge, wherein the dispenser base has a key pattern, wherein the cosmetic insert cartridge and the dispenser base have a matching second key pattern combination wherein the key pattern of the cosmetic insert cartridge matches the key pattern of the dispenser base;

wherein the second key pattern combination is different than the first key pattern combination;

wherein each cosmetic insert cartridge comprises an elongate body with a proximal end and a distal end, wherein the elongate body has a keyway member with a keyway, and wherein the key pattern is formed in the keyway in the keyway member;

wherein each dispenser base has a key member and wherein the key pattern is formed on the key member;

wherein the key pattern formed in the keyway of the keyway member of the keyed cosmetic insert cartridge of at least one of the keyed refillable cosmetic dispensers comprises circumferentially spaced teeth separated by channels, wherein the key pattern formed on the key member of the at least one of the keyed refillable cosmetic dispensers comprises plural teeth sized and angularly spaced over the key member to align with and be received into the channels between the teeth of the key pattern of the keyway member of the of the keyed insert cartridge of the at least one of the keyed refillable cosmetic dispensers;

wherein each of the first and second key pattern combinations intermesh when the cosmetic insert cartridge of the respective keyed refillable cosmetic dispenser is received by the respective keyed dispenser base.

17. The line of keyed refillable cosmetic dispensers of claim 16 further comprising a third keyed refillable cosmetic dispenser comprising a keyed cosmetic insert cartridge with a key pattern and a keyed dispenser base for receiving the cosmetic insert cartridge, wherein the dispenser base has a key pattern, wherein the cosmetic insert cartridge and the dispenser base have a matching third key pattern combination wherein the key pattern of the cosmetic insert cartridge matches the key pattern of the dispenser base, and wherein the third key pattern combination is different than the first and second key pattern combinations.

18. The line of keyed refillable cosmetic dispensers of claim 16 wherein each cosmetic insert cartridge further comprises an elevator cup disposed within the elongate body for retaining the stick cosmetic and a rotary extension and retraction mechanism for selectively adjusting the elevator cup between a retracted position and an extended position relative to the elongate body.

19. The line of keyed refillable cosmetic dispensers of claim 18 wherein each cosmetic insert cartridge further comprises a spiral member concentric with the elongate body, wherein the elongate body has at least one longitudinal track therethrough, wherein the spiral member has at least one spiral formation, and wherein the elevator cup has a sidewall and at least one lug that projects from the sidewall, through the at least one longitudinal track, and into engagement with the at least one spiral formation whereby the elevator cup can be manipulated between the retracted position and the extended position by a relative rotation of the elongate body and the spiral member.

20. The line of keyed refillable cosmetic dispenser of claim 16 wherein the key member of each dispenser base comprises a column and wherein the key pattern is formed on the column.

21. The line of keyed refillable cosmetic dispensers of claim 16 wherein the key pattern of the cosmetic insert cartridge of the first keyed refillable cosmetic dispenser cannot intermesh with the key pattern of the dispenser base of the second keyed refillable cosmetic dispenser.

22. The line of keyed refillable cosmetic dispensers of claim 21 wherein the matching first key pattern of the cosmetic insert cartridge and the dispenser base of the first keyed refillable cosmetic dispenser is disposed at a given pitch, wherein the matching second key pattern of the cosmetic insert cartridge and the dispenser base of the second keyed refillable cosmetic dispenser is disposed at a given pitch, and wherein the pitch of the matching first key pattern is different than the pitch of the matching second key pattern.

23. The line of keyed refillable cosmetic dispensers of claim 16 wherein the key pattern formed on the key member of the dispenser base of each of the first and second keyed refillable cosmetic dispensers comprises at least two series of teeth each spaced over less than 180 degrees.

24. The line of keyed refillable cosmetic dispensers of claim 23 wherein the key pattern formed on the key member of the dispenser base comprises two series of teeth each spaced over approximately 90 degrees.

25. The line of keyed refillable cosmetic dispensers of claim 23 wherein the matching first key pattern of the cosmetic insert cartridge and the dispenser base of the first keyed refillable cosmetic dispenser is disposed at a given pitch, wherein the matching second key pattern of the cosmetic insert cartridge and the dispenser base of the second keyed refillable cosmetic dispenser is disposed at a given pitch, and wherein the pitch of the matching first key pattern is different than the pitch of the matching second key pattern.

26. A keyed cosmetic insert cartridge for a keyed refillable cosmetic dispenser for a stick cosmetic, the cosmetic insert cartridge comprising:

an elongate body with a proximal end and a distal end;

an elevator cup disposed within the elongate body for retaining the stick cosmetic;

an extension and retraction mechanism for selectively adjusting the elevator cup between a retracted position and an extended position relative to the elongate body; and a key pattern disposed in the proximal portion of the elongate body wherein the elongate body has a keyway and wherein the key pattern is formed in the keyway and wherein the key pattern formed in the keyway comprises circumferentially spaced teeth separated by channels.

27. The keyed cosmetic insert cartridge of claim 26 wherein the elongate body comprises an inner body and further comprising an outer body comprising a spiral member concentrically disposed with the elongate body, wherein the inner body has at least one longitudinal track therethrough, wherein the spiral member has at least one spiral formation, and wherein the elevator cup has a sidewall and at least one lug that projects from the sidewall, through the at least one longitudinal track, and into engagement with the at least one spiral formation whereby the elevator cup can be manipulated between the retracted position and the extended position by a relative rotation between the inner body and the spiral member.

28. The keyed cosmetic insert cartridge of claim 27 wherein a proximal portion of the inner body extends proximally beyond a proximal portion of the outer body and further comprising a shell with an outer wall and a bottom ring with a keyhole opening wherein the outer wall of the shell is received over the proximal portion of the outer body, wherein the proximal portion of the inner body is encased by the shell, and wherein access to the key pattern of the inner body is provided through the keyhole opening in the bottom ring of the shell.

29. A keyed dispenser base for a keyed refillable cosmetic dispenser for a stick cosmetic with a cosmetic insert cartridge with a key pattern formed therein comprising circumferentially spaced teeth separated by channels, the dispenser base comprising:

a tubular member for receiving the cosmetic insert cartridge wherein the tubular member has a proximal end, a distal end, and a body portion with an inner volume; and a key member fixed within the tubular member wherein the key member comprises a central column with a tip portion that extends within the inner volume of the body portion from the proximal end of the body portion;

wherein the central column of the key member has a key pattern wherein the key pattern comprises plural teeth sized and angularly spaced over the central column of the key member with spaces between the teeth for receiving the teeth of the key pattern of the cosmetic insert cartridge.

30. The keyed dispenser base of claim 29 wherein the key pattern formed on the key member of the dispenser base comprises at least two series of teeth each spaced over less than 180 degrees.

31. The keyed refillable cosmetic dispenser of claim 30 wherein the key pattern formed on the key member of the dispenser base comprises two series of teeth each spaced over approximately 90 degrees.

* * * * *